United States Patent [19]

Harwood

[11] Patent Number: 4,804,877

[45] Date of Patent: Feb. 14, 1989

[54] PROTECTIVE COVERS FOR DISPLAY CASES

[75] Inventor: John W. Harwood, Alexandria, Va.

[73] Assignee: Harwood Protection Industries Inc., Newington, Va.

[21] Appl. No.: 12,169

[22] Filed: Feb. 9, 1987

[51] Int. Cl.[4] ..... A47F 3/00

[52] U.S. Cl. ..... 312/114; 109/49.5; 150/52 R; 312/137; 312/210; 312/258

[58] Field of Search ..... 312/114, 137, 210, 217, 312/258, 284, 297, 138 R; 109/49.5, 24, 65, 78; 160/327, 354, 368 R; 150/52 R, 52 F; 70/78

[56] References Cited

U.S. PATENT DOCUMENTS

| | | | |
|---|---|---|---|
| 120,874 | 11/1871 | Holmes et al. | 109/24 |
| 917,705 | 4/1909 | Benjamin . | |
| 1,095,484 | 5/1914 | Wright | 312/297 X |
| 1,255,407 | 2/1918 | Goetz . | |
| 1,572,429 | 2/1926 | Grither, Jr. | 312/258 X |
| 1,920,882 | 8/1933 | Pellow . | |
| 2,326,713 | 8/1943 | Wesseler | 109/49.5 X |
| 2,515,466 | 7/1950 | Nahmens . | |
| 2,589,699 | 3/1952 | Johnson . | |
| 2,605,617 | 8/1952 | Replogle | 312/258 X |
| 2,677,588 | 5/1954 | Couse . | |
| 2,717,018 | 9/1955 | Wagner | 150/52 R |
| 2,865,569 | 12/1958 | Levenberg | 312/210 X |
| 2,943,901 | 7/1960 | Eaton et al. . | |
| 3,116,097 | 12/1963 | Novales . | |
| 3,120,076 | 2/1964 | Zuch . | |
| 3,241,899 | 3/1966 | Donker . | |
| 3,434,769 | 3/1969 | Salet . | |
| 3,805,816 | 4/1974 | Nolte | 160/327 X |
| 3,855,898 | 12/1974 | McDonald | 109/49.5 X |
| 4,011,943 | 3/1977 | Galli et al. . | |
| 4,128,285 | 12/1978 | Lore et al. . | |
| 4,280,414 | 7/1981 | Allshouse et al. | 109/49.5 |
| 4,285,558 | 8/1981 | Medford . | |
| 4,345,635 | 8/1982 | Solomon . | |
| 4,560,214 | 12/1985 | Otema | 312/138 R X |
| 4,605,267 | 8/1986 | Rinkewich . | |

FOREIGN PATENT DOCUMENTS

| | | | |
|---|---|---|---|
| 2516281 | 5/1983 | France | 312/137 |

*Primary Examiner*—Kenneth J. Dorner
*Assistant Examiner*—Thomas A. Rendos
*Attorney, Agent, or Firm*—Roylance, Abrams, Berdo & Goodman

[57] ABSTRACT

Protective covers for elevated display cases having multiple faces including at least one glass face, for example, a jewelry display case. The protective covers include a plurality of panels of a non-frangible, rigid material. The panels are of a size and shape sufficient to cover the glass faces of the display case. The panels are joined together, one edge, by a plurality of hinge assemblies. Since each panel is attached to the joining panel by a hinge assembly, the protective cover is foldable such the panels lie in approximately parallel planes. The cover, when unfolded is comprised of one or more columns and one or more rows of the panels, depending on the size and shape of the display case being protected. The ends of each row or column of two or more panels have latching members attached thereto. These latching members are compatible with latching assemblies attached to the display case to affix the protective cover to the display case.

21 Claims, 5 Drawing Sheets

PROTECTIVE COVERS FOR DISPLAY CASES

FIELD OF THE INVENTION

This invention relates to protective covers for fixed display cases. More particularly, this invention relates to such covers which are removable and have at least one panel of non-frangible material which overlies at least one face of the display cases when the covers are affixed to the display cases.

BACKGROUND OF THE INVENTION

Many valuable items, such as jewelry, are displayed for sale in retail establishments in display cases having at least one glass face. These display cases are usually elevated off the floor by a support structure. These display cases are fully enclosed and usually kept locked since the retailers want to limit access to the valuable items to prevent shoplifting, breakage, etc. The glass faces are provided, of course, so that customers can view the jewelry or other valuable items in the display cases.

As stated, these elevated display cases have at least one glass face. Frequently, such display cases have two or more glass faces so that the items being displayed can be viewed at different angles and to let a maximum amount of light into the display cases. Since these display cases are usually locked, when a customer wants to handle a particular item, he or she must summon a clerk at the store who, using a key, opens the display case and removes the item for the customer's viewing.

Thus, it is clear that display cases having glass faces are vital to the sale of valuable items such as jewelry. These items must be kept in a locked cabinet to prevent shoplifting an damage due to mishandling, yet the items must be visible to consumers.

However, use of glass-faced display cases presents a problem during times when the establishment is closed. This problem develops when the valuable items are left in the display cases overnight. This is often done, due to the lack of storage space for the valuable items other than the display cases and due to the time involved in removing all the valuable items from the display cases each and every night at closing and then repositioning the items in an aesthetically pleasing display each and every morning when the retail establishment reopens.

Thieves have learned to take advantage of situations when valuable items are left in glass display cases overnight.

In fact, a special "plan" of burglary has developed taking advantage of these glass-faced display cases. This "plan" is as follows. The burglars, who usually work in at least teams of two, first break into the establishment. One burglar proceeds to smash all of the glass faces of the display cases. The other burglar then follows behind and removes the items from the display cases. This type of burglary is often called a "three minute robbery" since the burglary, once entry is gained into the retail establishment, can be completed in only three minutes.

Due to the increasing frequency of these burglaries, there has arisen a need to deter this type of crime. Conventional burglar alarms are not sufficient since these burglaries are conducted so fast that the burglars escape before the police or security personnel have time to respond to the alarm. Thus, there is a need to protect the glass display cases so that the glass faces cannot be quickly and easily shattered. The longer it takes burglars to break into the glass display cases, the greater the deterent to this type of crime, as it gives police and security personnel more time to respond to the burglar alarm.

Attempts have been made to provide protective means for display cases or similar structures. A first type of the devices which has been developed includes screen members which can be pulled down over the display cases or similar structures to protect the goods therein. Examples of such screen members are disclosed in U.S. Pat. Nos. 917,705 issued to Benjamin on Apr. 6, 1909, 2,515,466 issued to Nahmens on July 18, 1950, 3,116,097 issued to Novales on Dec. 31, 1963, 3,241,899 issued to Donker on Mar. 22, 1966 and 4,345,635 issued to Solomon on Aug. 24, 1982.

However, these screen members have many disadvantages. First, the screen housing is always positioned adjacent the glass face or other opening being closed by the screen, even when the screen member is not being employed. This is not aesthetically pleasing, especially in environments such as jewelry display cases. Moreover, if the display case has multiple glass faces, a single screen cannot cover the multiple faces. Multiple screen members and housings must be employed, which render the devices even more undesirable. Further, it is often possible to pry or lift the edges of the screen member away from the opening being closed to gain access to the opening.

Another type of protective covers which has been developed to protect table tops, display cases, etc. are covers which are permanently affixed to the item being protected. These covers are rotatably attached to the item being protected so that when the covers are not in use, they are rotated away from the protected surface or area. Examples of this type of protective covers are disclosed in U.S. Pat. Nos. 1,920,882 issued to Pellow on Aug. 1, 1933, 2,589,699 issued to Johnson on Mar. 18, 1952, 2,677,588 issued to Couse on May 4, 1954, . 2,943,901 issued to Eaton et al on July 5, 1960, . 4,011,943 issued to Galli et al on Mar. 15, 1977, 4,285,558 issued to Medford on Aug. 25, 1981 and 4,605,267 issued to Rinkewich on Aug. 12, 1986.

While these fixed protective covers have utility in many environments, they cannot be employed to protect display cases for jewelry or other valuable items. This is because the fixed covers are always attached to the item being protected, even when not in use. This would be aesthetically displeasing to customers. In addition, such covers would get in the way and thus hinder sales personnel when the sales personnel attempt to show customers individual items of the protected goods. Moreover, often such display cases are "stand alone" items. Use of these fixed covers would prevent free movement around these display cases.

In addition, foldable table top enclosures have been developed, as have collapsible display cases. Examples of these devices are disclosed in U.S. Pat. Nos. 1,255,407 issued to Goetz on Feb. 5, 1918, 3,120,076 issued to Zuch on Feb. 4, 1964, 3,434,769 issued to Salet on Mar. 25, 1969 and 4,128,285 issued to Lore et al on Dec. 5, 1978.

These devices have the disadvantage that they are not adaptable to a display case having a plurality of glass faces. The collapsible enclosures only protect the top face of a desk or a table top. They do not protect any other faces of the desk or table, such as side and front faces. As discussed above, many display cases have side and front glass faces. These faces need to be protected the same as the top faces. Furthermore, the foldable display cases have glass faces and thus have the same problem as the fixed display cases with glass faces.

Therefore, it is clear that there is still a need in the art for a protective cover for display cases having multiple glass faces. This invention fulfills this need in the art, as well as other needs which will become apparent to those skilled in the art once given this disclosure.

SUMMARY OF THE INVENTION

This invention provides a protective cover for elevated display cases having multiple faces, including at least one glass face. The protective cover comprises a first panel of non-frangible, rigid material and of a size and shape to cover and overlie the glass face of the display case. When the protective cover is installed on the display case, this first panel is positioned directly adjacent and on top of the glass face. The cover includes at least one other panel of material of a size and shape to cover at least one of the other faces of the display case. When the protective cover is attached to the display case, this other panel is positionable adjacent the other face(s). The protective cover also includes a plurality of hinge assemblies. The panels are connected on edge to the hinge assemblies to form a row having first and second ends. The ends have latching members attached thereto which are compatible with latch assemblies attached to the display case.

In some embodiments of the invention, the cover is foldable so that when it is not in use, the cover can be folded to a compact size. When the cover is folded, the panels may lie in approximately parallel planes.

In some embodiments of the invention, the frangible material is opaque.

In yet other embodiments, the first panel has straight edges and each straight edge has a hinge assembly affixed thereto. The first panel may be rectangular, depending on the shape of the display case.

Also, in some embodiments, the first panel is designed to cover the top face of the display case.

The protective covers according to this invention have many advantages. First, the protective covers prevent the "three minute burglaries" discussed above from occurring. The burglars cannot simply, after obtaining entry into a retail establishment employing these protective covers, smash the glass faces of the display cases. The protective covers must first be removed. This impedes the burglary attempt, which provides police and other security personnel sufficient time to answer the burglar alarm before goods can be stolen.

In addition, the covers according to this invention can be easily installed on existing display cases as well as on display cases being constructed. No changes need to be made to the existing cases.

Further, the protective covers are easy to affix to the display cases when the store closes and to remove from the display cases when the store reopens. This ease of effort assures that the protective covers will always be employed, even when store personnel may be in a hurry.

Moreover, the protective covers are lightweight and can be handled by most store personnel. Further, the protective covers are foldable and collapsible such that little storage space is required. All the covers for the store or retail establishment can be easily stored in a back room, when not in use.

Furthermore, when the covers are not in use, there is little of nothing associated with the covers visible on the display cases. Thus, nothing associated with the protective covers has a detrimental aesthetic effect on the display cases.

Certain embodiments of this invention will now be described with respect to the Figures, wherein:

DETAILED DESCRIPTION OF THE DRAWINGS

Figure 1:
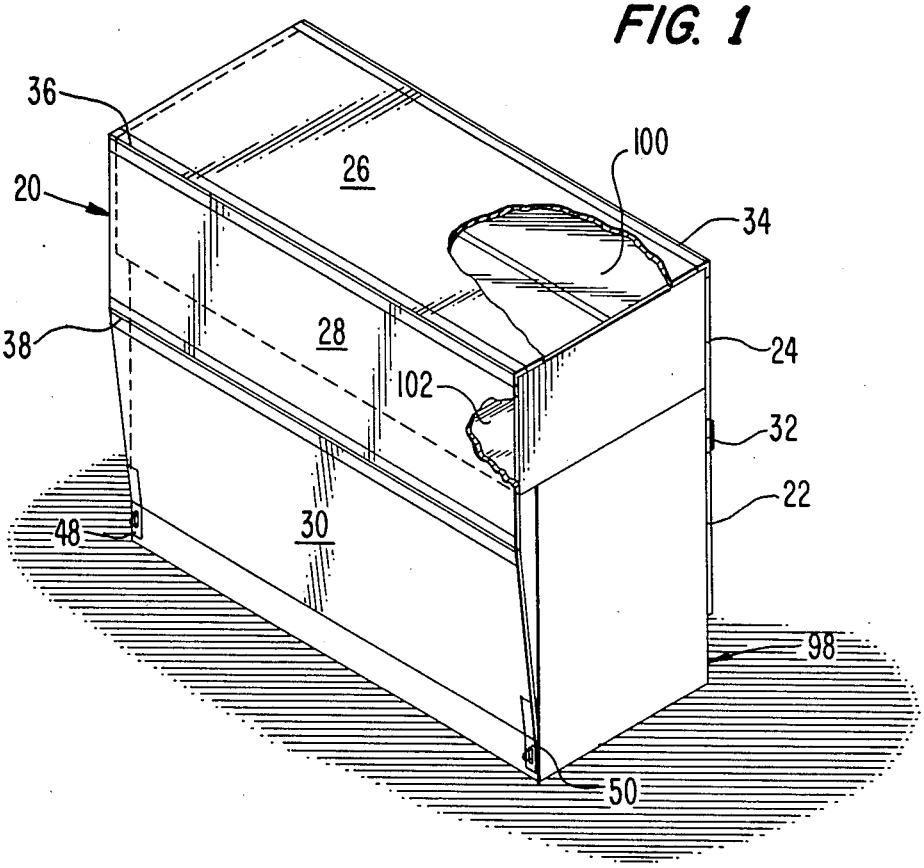
FIG. 1 is a perspective view of one embodiment of this invention attached to a display case.
Figure 3:
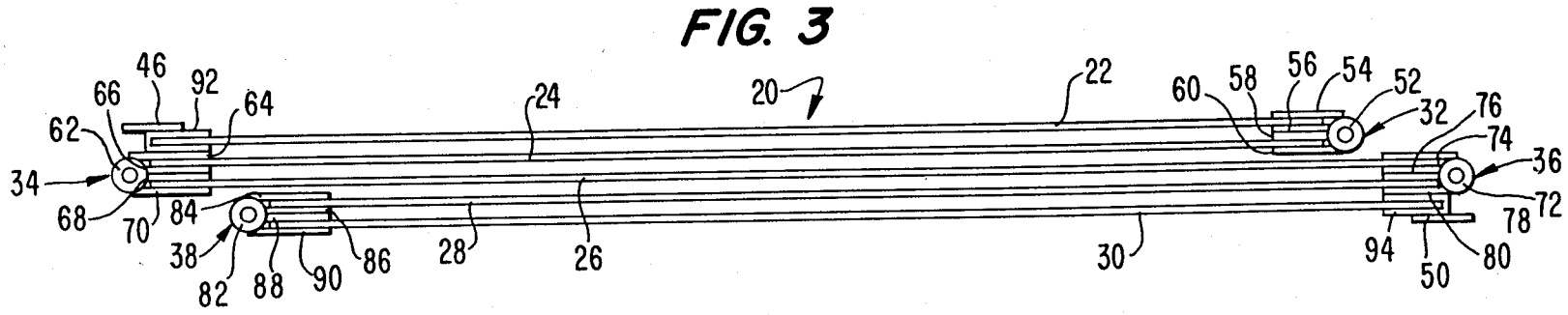
FIG. 3 is a side view of the embodiment of this invention illustrated in FIGS. 1 and 2 in the folded position.
Figure 2:
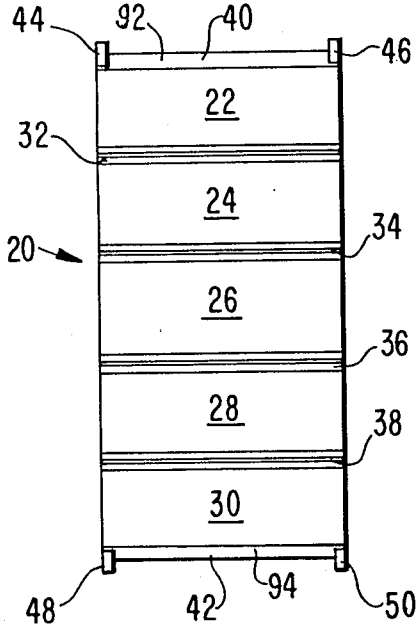
FIG. 2 is a top view of the embodiment of this invention illustrated in FIG. 1 in the unfolded position.

Referring to the Figures, in particular FIGS. 1–3, an embodiment of this invention, cover 20, is illustrated. Cover 20 is comprised of panels 22, 24, 26, 28 and 30 pivotally joined by hinge assemblies 32, 34, 36 and 38.

Hinge assemblies 32–38 are attached to the edges of the panels 22–30 and connect panels 22–30 in series. In particular, hinge assembly 32 is connected to adjacent edges of panels 22 and 24, hinge assembly 34 is attached to adjacent edges of panels 24 and 26, hinge assembly 36 is attached to adjacent edges of panels 26 and 28 and hinge assembly 38 is attached to adjacent edges of panels 28 and 30.

Panels 22–30 are thus aligned in a row (in the unfolded position, see FIG. 2) having first end 40 and second end 42. First end 40 is in actuality an edge of panel 22 and, likewise, second end 42 is in actuality an edge of panel 30.

Panels 22–30 are comprised of a non-frangible, rigid material which is resistant to breaking on impact. A preferred material is LEXAN® plastic. Moreover, the panels may be opaque.

In the embodiment illustrated in FIGS. 1–3, hinge assemblies 32–38 each include a knuckle member with four side plates assembled as a unit. The four side plates are arranged as two pair, as discussed below. In particular, hinge assembly 32 includes knuckle member 52 and side plates 54, 56, 58 and 60. Hinge assembly 34 is comprised of knuckle member 62 and side plates 64, 66, 68 and 70. Hinge assembly 36 is comprised of knuckle member 72 and side plates 74, 76, 78 and 80. Hinge assembly 38 is comprised of knuckle member 82 and side plates 84, 86, 88 and 90.

As illustrated in FIG. 3, edges of panels 22–30 are received between the pairs of plates associated with each hinge assembly 32–38 and attached thereto. This permits each of the panels to pivot about hinge assemblies 32–38 with respect to their adjacent panels.

In particular, one edge of panel 22 is received between and attached to side plates 54 and 56, one edge of panel 24 is received between and attached to side plates 58 and 60, the opposite edge of panel 24 is received between and attached to side plates 64 and 66, one edge of panel 26 is received between and attached to side plates 68 and 70, the opposite edge of side plate 26 is received between and attached to side plates 74 and 76, one edge of panel 28 is received between and attached to side plates 78 and 80, the opposite edge of panel 28 is received between and attached to side plates 84 and 86, and one edge of panel 30 is received between and attached to side plates 88 and 90 (see FIG. 3).

This construction enables cover 20 to be folded to a folded position, as illustrated in FIG. 3, with the panels 22–30 in approximately parallel orientation.

Protective cover 20 also includes elongated edge protectors 92 and 94. Edge protector 92 is positioned on and attached to the free edge of panel 22 opposite hinge assembly 32 (first end 40) and edge protector 94 is positioned on and attached to the free edge of panel 30 opposite hinge assembly 38 (second end 42). Protectors 92 and 94 are U-shaped.

Latching members 44 and 46 are attached to edge protector 92 and thus first end 40, and latching members 48 and 50 are attached to edge protector 94 and thus second end 42 of the row of panels. In this embodiment, latching members 44–50 are hasps. However, any type of latching mechanism can be employed.

Side plates 54–60, 64–70, 74–80 and 84–90 can be attached to panels 22–30 by any known fastening technique. For purposes of an example, FIG. 10 illustrates use of pop rivets.

Figure 10:
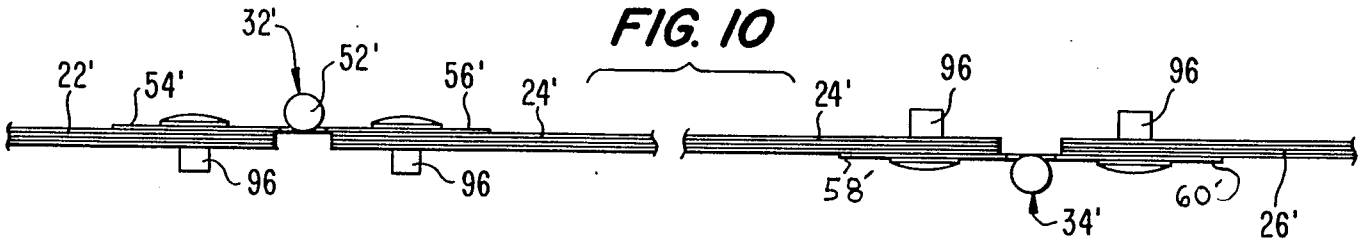
FIG. 10 is a partial side view of yet another embodiment of this invention.

In FIG. 10, panels 22′, 24′ and 26′ are joined in series by hinge assemblies 32′ and 34′. Pop rivets 96 attach the side plates 54′, 56′, 58′ and 60′ of hinge assemblies 32′ and 34′ to panels 22′–26′. Note that in this embodiment, each hinge assembly 32′ and 34′ only has a pair of side plates. One of these side plates is attached to each adjacent panel.

Furthermore, note that, in the embodiment illustrated in FIG. 10, hinge assembly 32′ is attached on the opposite side of panel 24′ from hinge assembly 34′. This alternation of sides of the panels for the hinge assemblies continues for each hinge assembly connecting the panels in a row. That is, every other hinge assembly would be on the same side of the panels. Also note in this embodiment that the panels are attached to the opposite side of the side plates from the knuckle members of the hinge assembly. That is, knuckle 52′ is on the opposite side of the plates 54′ and 56′ from panels 22′ and 24′, etc.

The protective covers according to this invention can be employed to cover almost all types, sizes and designs of display cases. For example, cover 20 may be employed to cover display cases such as display case 98 in FIG. 1 having a top glass face 100 and front glass face 102, which are protected and overlaid by panels 26 and 28. The staples which engage hasps 48–54 are attached to the lower portion of display case 98.

Figure 6:
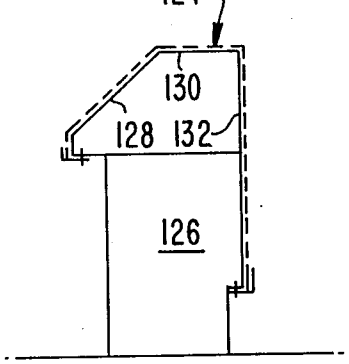
FIG. 6 is a schematic drawing illustrating a third embodiment of this invention attached to a display case.
Figure 5:
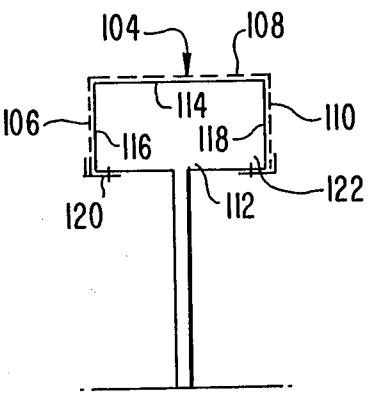
FIG. 5 is a schematic drawing illustrating a second embodiment of this invention attached to a display case.

Examples of other embodiments of the invention and the display cases with which they may be employed are schematically illustrated in FIGS. 5 and 6. In FIG. 5, a three panel protective cover, cover 104, is illustrated comprising panels 106, 108 and 110. Cover 104 is mounted on elevated display case 112 which has top glass face 114 and side glass faces 116 and 118. Cover 104 also includes hasp assemblies 120 and 122 attached on the ends of cover 104. Hasp assemblies 120 and 122 are underneath the top portion of display case 112 when over 104 is attached to display case 112. Thus, the staples of hasp assemblies are positioned underneath the top portion of display case 112, out of sight of consumers. Therefore, in this embodiment, glass faces 114, 116 and 118 are protected by panels 108, 106 and 110, respectively, when cover 104 is affixed to display case 112.

FIG. 5 illustrates another five panel embodiment of this invention, cover 124, affixed to display case 126. Display case 126 has glass faces 128, 130 and 132. These faces are all covered by the panels of cover 124.

Figure 7:
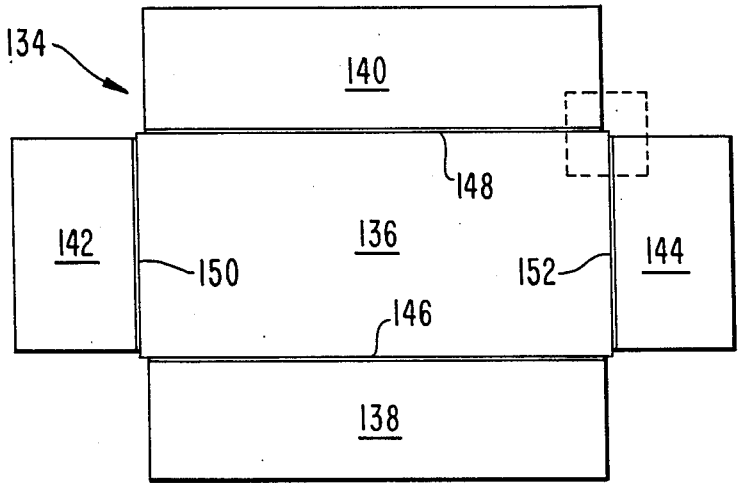
FIG. 7 is a top view of a fourth embodiment of this invention, the embodiment being in the unfolded position.
Figure 8:
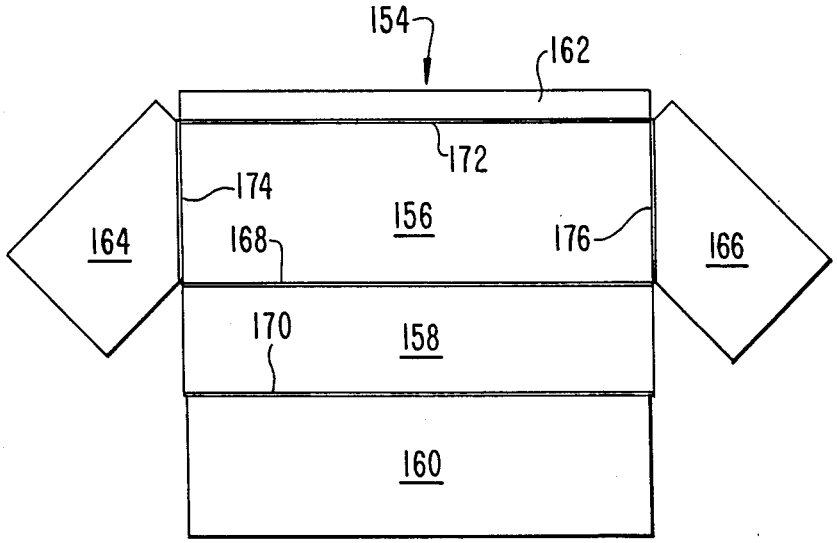
FIG. 8 is a top view of a fifth embodiment of this invention, the embodiment being in the unfolded position.

Further embodiments of the invention are illustrated in FIGS. 7 and 8. The embodiment of FIG. 7, cover 134, is designed to be employed on a display case having glass faces on the top and all sides. Thus, protective cover 134 includes top panel 136, front panel 138, rear panel 140 and side panels 142 and 144. Panels 138–144 are all rotatably attached to top panel 136 by hinge assemblies 146, 148, 150 and 152, respectively.

The embodiment illustrated in FIG. 8, protective cover 154, includes top panel 156, front panels 158 and 160, back panel 162, and side panels 164 and 166. Panel 158 is rotatably attached to panel 156 by hinge assembly 168. Panel 160 is rotatably attached to panel 158 by hinge assembly 170. In addition, back panel 162 is rotatably attached to top panel 156 by hinge assembly 172 and side panels 164 and 166 are rotatably attached to top panel 156 by hinge assemblies 174 and 176, respectively. Protective cover 154 is designed to be utilized on display cases having a sloped front face. That is, when cover 154 is attached to such a display case, panel 156 covers the top of the display case, panel 154 covers the sloping front face of the display case, and side panels 164 and 166 cover the side faces of the display case.

Latching assemblies (not shown) are provided at the free edges of panels 138–144 of cover 134 in FIG. 7 and the free edges of panels 160–166 of protective cover 154 in FIG. 8 to attach covers 134 and 154 to display cases.

Figure 9:
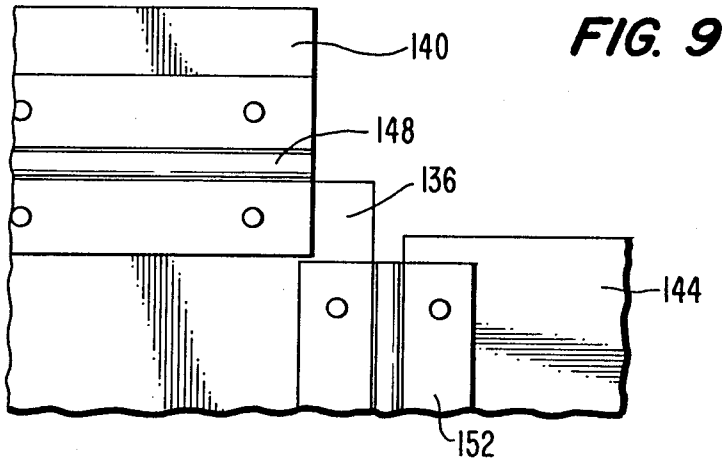
FIG. 9 is an enlarged top view of the area bounded by the dashed line in FIG. 7.

FIG. 9 is an enlargement of the area within the dashed line in FIG. 7. FIG. 9 shows the detail of the attachment of hinges 148 and 152 to panels 136, 140 and 144.

Figure 11:
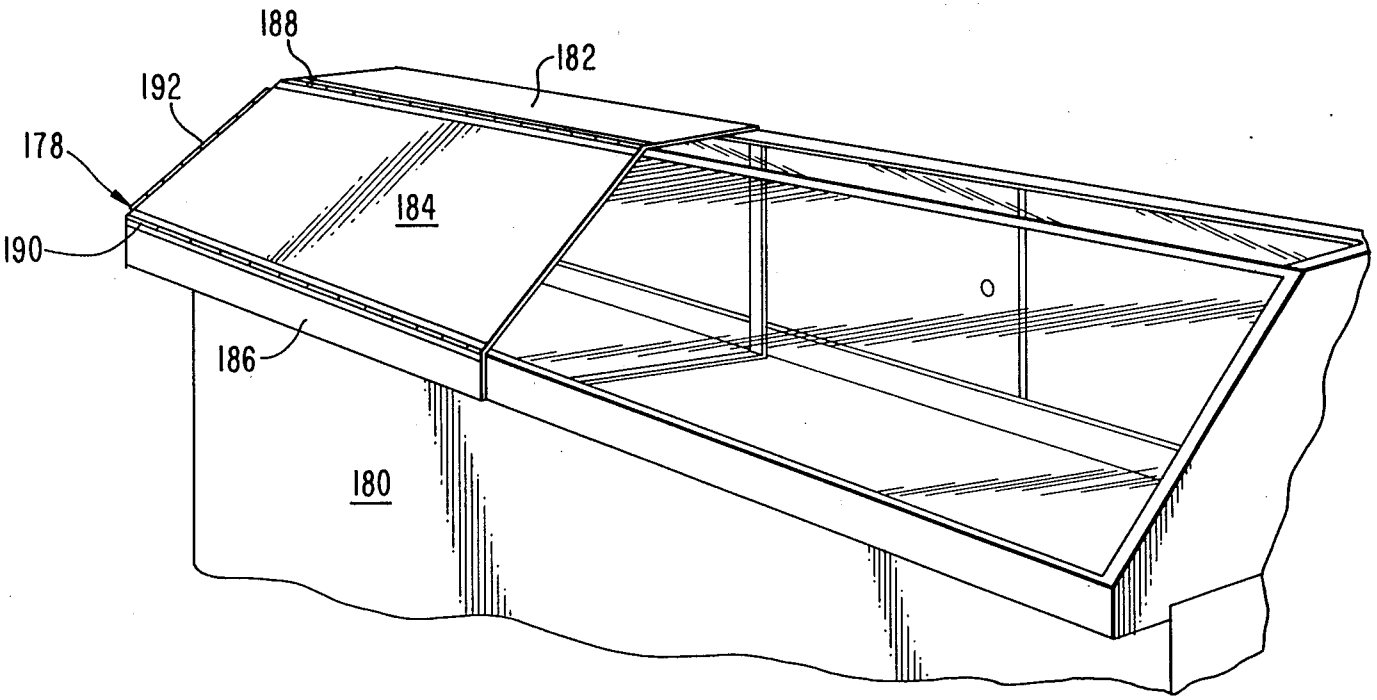
FIG. 11 is a perspective view of a further embodiment of this invention affixed to a portion of a display case.

FIG. 11 illustrates another embodiment of this invention, protective cover 178, attached to display case 180. Cover 178 includes top panel 182, sloping front panel 184 and front panel 186. Top panel 182 is rotatably attached to sloping front panel 184 by hinge assembly 188. Front panel 186 is rotatably attached to sloping front panel 184 by hinge assembly 190. Likewise, a side panel (not shown) is attached to sloping front panel 184 by hinge assembly 192.

It is clear from the above description of the invention that the panels comprising a protective cover according to this invention can be of any shape. Further, the sizes of the panels may vary, depending on the size and shape of the display case being protected.

Moreover, the number and arrangement of panels which comprise a protective cover according to this invention may vary, again depending on the shape and size of the display case being protected. The panels can be arranged in any number of rows and columns. The ends of each row and column of two or more panels have latching members attached thereto.

Figure 4:
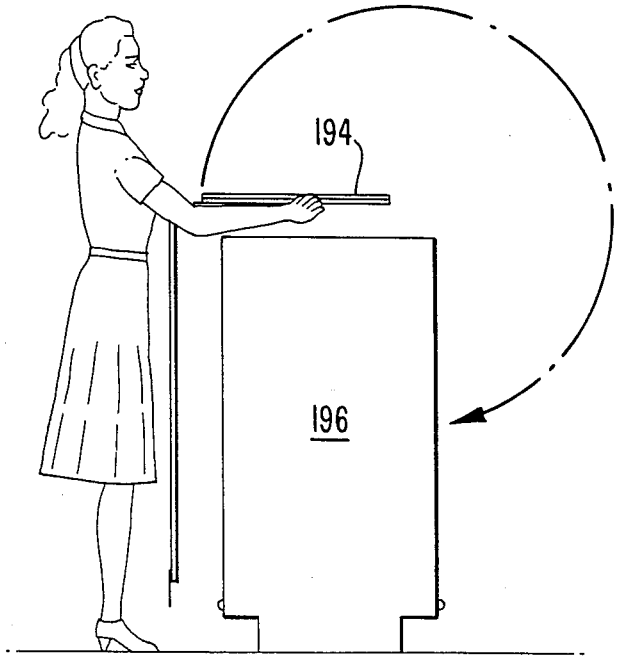
FIG. 4 is a schematic drawing illustrating the installation of the embodiment of this invention illustrated in FIGS. 1–3 onto a display case.

FIG. 4 illustrates the placing of a protective cover according to this invention, cover 194, onto a display case, display case 196. First, assuming that cover 194 is in the folded position, the cover is unfolded as shown by the arrow in FIG. 4. Each successive panel is rotated relative the preceding panel. The cover is then placed in its approximate final position and the latching members located on the ends of cover 194 engaged with the latch assemblies attached to case 196.

Protective cover 194 can easily be removed from case 196 and refolded by unlatching cover 194 from display case 196 and folding cover 194 in the opposite direction shown by the arrow in FIG. 4.

Once given this disclosure, many other improvements, modifications, and embodiments of the invention will become obvious to those of skill in the art. Such other modifications, improvements and embodiments are considered to be within the scope of this invention as defined by the following claims:

What is claimed:

1. A protective cover in combination with an elevated display case, the combination comprising:

an elevated display case having multiple faces including at least one glass face;

a first panel of non-frangible, rigid material and of a size and shape designed to cover said glass face of said elevated display case, said first panel being positioned adjacent said glass face;

at least one other panel of a shape and size designed to cover at least one of said other faces, said other panel being positioned adjacent said one other face; and a plurality of hinge assemblies, said panels being connected on edge by said hinge assemblies to form a row having first and second ends;

said ends having latching members attached thereto which are compatible with latching assemblies attached to said display case.

2. The combination according to claim 1 wherein said cover is foldable when not in use such that said panels lie in approximately parallel planes.

3. The combination according to claim 1 wherein said non frangible material is opaque.

4. The combination according to claim 1 wherein said first panel has straight edges and each straight edge has a hinge assembly affixed thereto.

5. The combination according to claim 4 wherein said first panel is rectangular.

6. The combination according to claim 5 wherein said first panel is designed to cover a top face of said display case.

7. The combination according to claim 6 further comprising side panels which are pivotally attached to said first panel.

8. The combination according to claim 1, wherein said row of panels includes at least four panels.

9. A removable and collapsible cover in combination with an elevated display case, the combination comprising:

an elevated display case having multiple faces including at least one glass face;

a plurality of panels comprised of a non-frangible, rigid material;

hinge assemblies pivotally attaching edges of said panels to form a row of said panels having ends; and latching members attached to the ends of said row of panels;

wherein said cover is positioned on said elevated display case such that said panels are positioned adjacent to and cover said glass face and said latching members interface with latching assemblies affixed to said display case to attach said cover to said display case.

10. The combination according to claim 9 wherein said cover is foldable when not in use such that said panels lie in approximately parallel planes.

11. The combination according to claim 9 wherein a first of said panels has straight edges and each straight edge has a hinge assembly affixed thereto.

12. The combination according to claim 11 wherein said panels are rectangular.

13. The combination according to claim 11 wherein said first panel is designed to cover a top face of said display case.

14. The combination according to claim 13 and further comprising side panels which are pivotally attached to said first panel.

15. A protective cover in combination with an elevated display case, the combination comprising:

an elevated display case having a plurality of glass faces;

panels of non-frangible material;

hinge assemblies connecting a plurality of said panels on edge to form a row of said panels having first and second ends;

latching members affixed to said first and second ends; and latching assemblies affixed to said elevated display case;

said latching members being compatible with said latching assemblies to affix said cover to said display case;

wherein when said cover is affixed to said display case, said panels cover said glass faces.

16. The combination according to claim 15 wherein said cover is foldable when not in use such that said panels lie in approximately parallel panels.

17. The combination according to claim 15 wherein a first of said panels has straight edges and each said straight edge has a hinge assembly affixed thereto.

18. The combination according to claim 17 wherein said first panel is designed to cover a top face of said display case.

19. The combination according to claim 18 and further comprising side panels which are pivotally attached to said first panel.

20. The combination according to claim 15 wherein some of said panels are attached to the row of panels such that said panels are arranged in columns and rows.

21. The combination according to claim 20 wherein each free edge of said panels which is not attached to one of said hinge assemblies has one of said latching members attached thereto.

* * * * *